US006622946B2

(12) United States Patent
Held et al.

(10) Patent No.: US 6,622,946 B2
(45) Date of Patent: Sep. 23, 2003

(54) DEVICE FOR COATING WORKPIECES

(75) Inventors: Thomas Held, Burladingen (DE); Frank Hummel, Engstingen (DE); Martin Speidel, Hohenstein (DE); Andreas Zimmermann, Reutlingen (DE)

(73) Assignee: Sieghard Schiller GmbH & Co. KG, Sonnenbuehl (DE)

( * ) Notice: Subject to any disclaimer, the term of this patent is extended or adjusted under 35 U.S.C. 154(b) by 0 days.

(21) Appl. No.: 09/825,204

(22) Filed: Apr. 3, 2001

(65) Prior Publication Data

US 2002/0020768 A1 Feb. 21, 2002

(30) Foreign Application Priority Data

Apr. 13, 2000 (DE) ..... 100 18 291

(51) Int. Cl.[7] ..... B05B 1/14
(52) U.S. Cl. ..... 239/551; 239/562

(58) Field of Search ..... 239/562, 548, 239/550, 551, 566, 583, 569, 574, 564, 99; 137/596.2; 222/561, 559

(56) References Cited

U.S. PATENT DOCUMENTS 3,866,806 A * 2/1975 Shapland, Jr. ..... 222/561
4,000,837 A * 1/1977 Walther ..... 222/512

FOREIGN PATENT DOCUMENTS

DE 2 254 449 5/1974
DE 27 34 627 2/1978
DE 197 54 817 A1 6/1999

* cited by examiner

*Primary Examiner*—Lisa A. Douglas
(74) *Attorney, Agent, or Firm*—Michael J. Striker

(57) ABSTRACT

A device for coating of workpieces has an application unit provided with a distributing plate which has at least one nozzle and at least one valve unit, the at least one valve unit being formed as a plate valve with at least one inlet slider and at least one outlet slider.

14 Claims, 2 Drawing Sheets

DEVICE FOR COATING WORKPIECES

BACKGROUND OF THE INVENTION

The present invention relates to a device for coating of workpieces, with an application unit having a distributing plate provided with at least one nozzle and at least one valve unit.

Such coating devices are used for example for coating of electric chips utilized in smart cards. The chips are arranged in a row or several rows on a support film. In these applications, very small, exactly defined quantities of coating material must be applied on the individual chip. At the same time, verify accuracy requirements for the coating device are applicable. In known coating devices with diaphragm valves, during opening and closing of the valve which provides dosing of the coating quantity, the material is displaced, and it is possible that the coating quantity is not dosed with the required accuracy. Significant deviations in the supply passages which guide the coating material produce an undesirable air cushion which is difficult to eliminate. When different materials must be treated, then under certain conditions the coating devices or parts of the devices must be exchanged with other which are adapted to these materials. The utilization of glass fiber-filled coating materials can lead to clogging of such valves.

SUMMARY OF THE INVENTION

Accordingly, it is an object of present invention to provide a device for coating of workpieces, which are improved so that they eliminate the disadvantages of the prior art.

In keeping with these objects and with others which will become apparent hereinafter, one feature of present invention resides, briefly stated, in a device for coating of workpieces with an application unit, which has at least one distributing plate provided with at least one nozzle and at least one valve unit, wherein the at least one valve unit is formed as a plate valve (or a single-face valve) with at least one inlet slider and at least one outlet slider.

With the inventive device, before the application of the coating material the material is dosed in the application unit. For dosing, the at least one inlet slider is opened and the at least one outlet slider is closed. Subsequently for application of the coating material, the inlet slider is closed and the outlet slider is opened. In this manner the back displacement of the material or the droplet formation are avoided. Furthermore, the at least one inlet slider and the at least one outlet slider when necessary can be exchanged. This provides for substantially lower mounting expenses for than existing mounting and dismounting valves.

At least one intermediate plate with at least one material-guiding passage is provided for dosing of the material quantity between the at least one inlet slider and the at least one outlet slider. The at least one material-guiding passage is filled during dosing of the coating material, and is emptied during the subsequent coating.

The valve unit can be provided with at least one pressing plate which is loaded with a tensioning module and has at least one material-guiding passage. Thereby the at least one inlet slider and the at least one outlet slider which are susceptible to wear can be post-treated on their surface, and subsequently despite their reduced thickness, provide a tight closure.

The tightening module can be formed as a cylinder-piston device. In this case it operates simultaneously and has a long-term stability. The tightening module can produce a stroke-independent tensioning force.

At least one opening which receives a piston can be provided in at least one intermediate plate and laterally open into the at least one material-guiding passage. By withdrawing of the at least one piston, the volume of the at least one material-guiding passage in the at least one intermediate plate can be increased. During dosing of the coating material in the at least one material-guiding passage of the intermediate plate, the at least one opening which receives the piston can be released by a lateral displacement of the piston. Thereby the dosed coating material can be supplied in the opening which receives at least the one piston. During application of the coating material, the piston is moved in the opposite direction and thereby the coating material is displaced from the opening which receives at least one piston. The piston, depending on the application and the utilized material, can be pulled more or less, and thereby the flexibility of the device is increased.

The end side of the piston which faces the at least one material-guiding passage can be adjusted to the curved course of the wall of the material-guiding passage. Therefore an insertion of the piston in the material-guiding passage of the intermediate plate is avoided, which can lead to air pocket under the piston in the material-guiding passage. Advantageously, the at least one piston can be driven by a motor, and can be provided with a control, so that a compensation of the material decompression is performed. As a result, during opening of the inlet slider the material is supplied under pressure into the piston openings and the material guiding passage, or in other words compressed, and after opening of the outlet slider is relaxed. This can lead to droplet formations or to a greater material discharge.

The piston receptacle of the at least one piston can be coupled with the piston drive plate in direction toward the piston axis with the intermediate plate. Therefore with the post-treated plates of the at least one inlet slider and at least one outlet slider, the at least one piston can follow the new position of the intermediate plate. The above mentioned coupling can be formed for example through at least one eccentric shaft. The eccentric shaft presses the piston receptacle in direction of the piston longitudinal axis against the drive plate.

In order to avoid air inclusions in the material-guiding passage, the material-guiding passage can be guided so that the material performs deviation by at most 90°.

For reducing the wear of the sealing surfaces of the at least one inlet slider and the at least one outlet slider, the outer surface of the at least one inlet slider and the at least one outlet slider can be provided with projecting sliding regions.

In the event of wear of the sliding regions, in order to avoid exchanging of the complete inlet slider, outlet slider, the at least one intermediate plate, and the at least one pressing plate, these sliding regions can be formed as exchangeable inserts.

For avoiding air inclusions, the material-guiding passages can also reduce from the material inlet to the material outlet.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
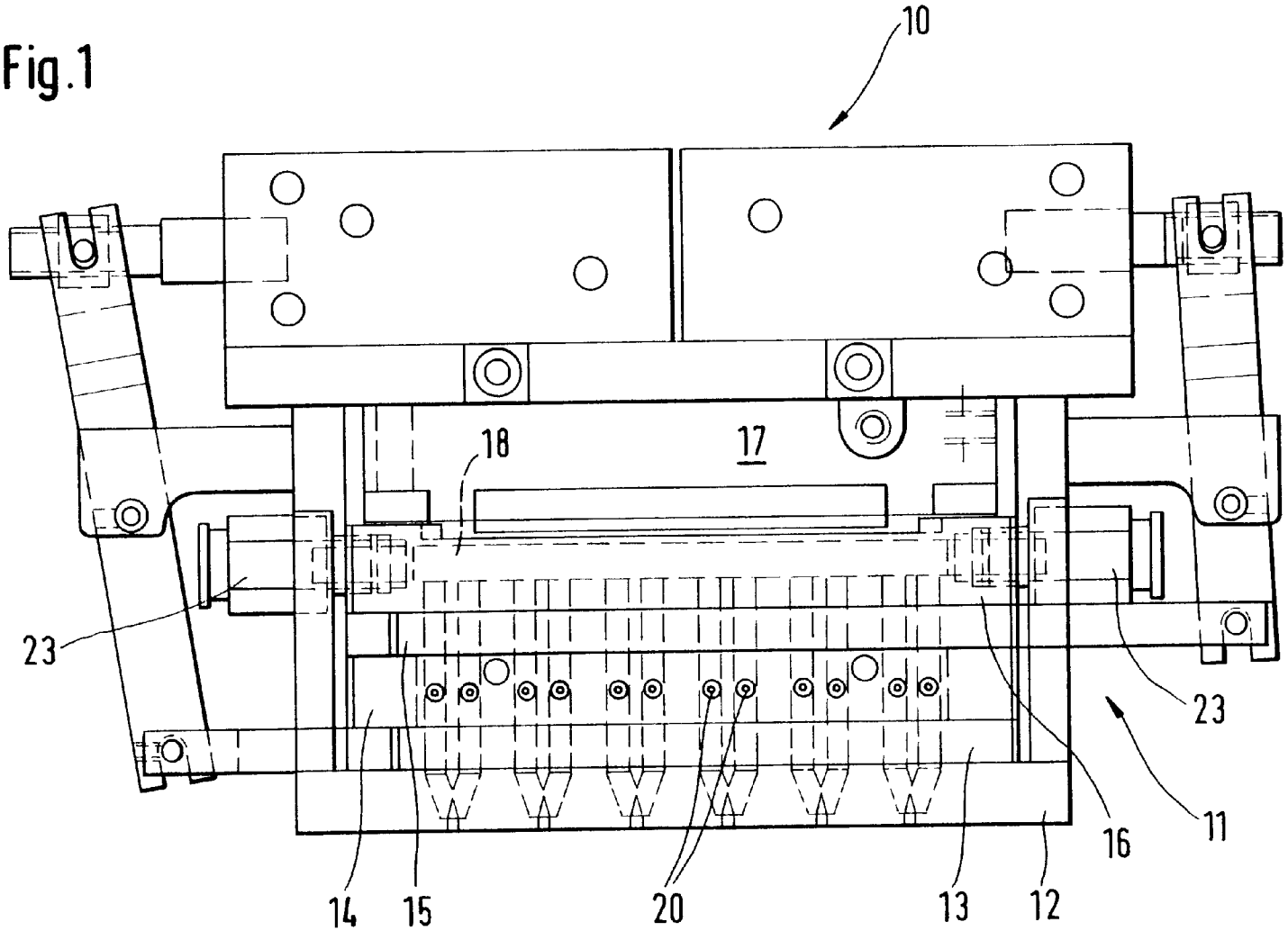
FIG. 1 is a side view of a device for coating of workpieces in accordance with the present invention.
Figure 2:
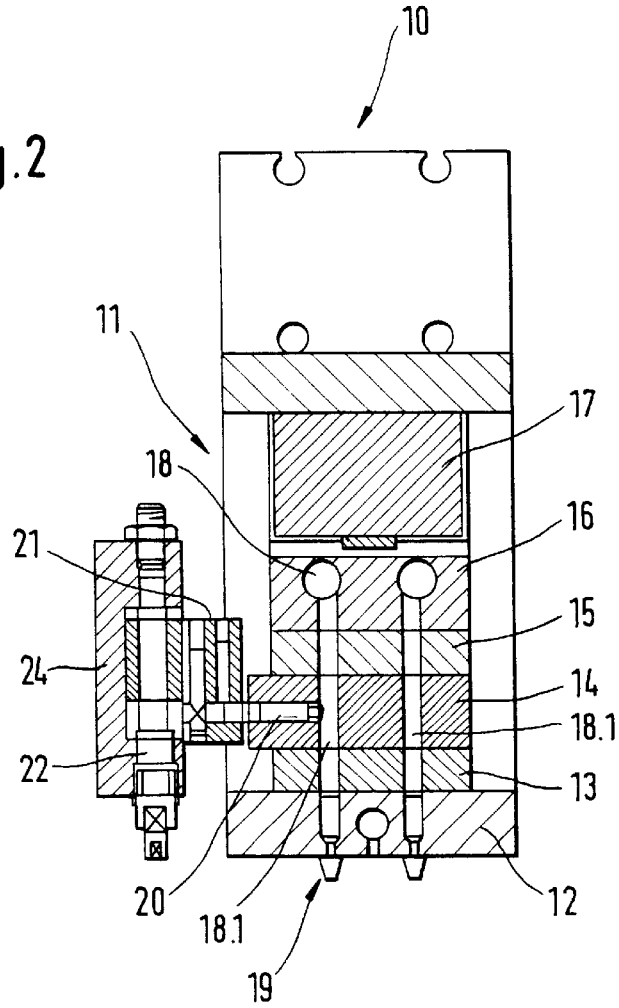
FIG. 2 is a sectional view of the inventive device for coating of workpieces of FIG. 1.

A device for coating of workpieces is identified as a whole with reference numeral 10 in FIGS. 1 and 2. It has an application unit 11. The application unit 11 has a distributing plate 12 with twelve discharge nozzles, and a valve unit with an outlet slider 13, an intermediate plate 14, and an inlet slider 15. A pressing plate 16 and a tensioning module 17 which acts on the pressing plate 16 serve for providing the tightness of the valve unit.

The coating material is supplied through two material guiding passages 18 in the pressing plate 6 to the valve unit. Before the application of the material, the coating material is dosed in the material guiding passages 18.1 of the intermediate plate 14 shown in FIG. 2. For this purpose the outlet slider 13 is closed and the inlet slider 15 is opened. Subsequently, the piston 20 is moved outwardly. Thereby the volume of the material guiding passage 18 is increased in correspondence with the quantity to be applied. After the material guiding passage 18.1 is filled with the coating material, the inlet slider 15 is also closed.

The outer surface of the plate of the outlet slider 13 and the inner slider 15 must be post-treated because of wear. As a result, a reduction of the plate thickness occurs. The tensioning module 17 then compresses via the pressing plate 16, the plate of the inlet slider 15, the intermediate plate 14, and the outlet slider 13, so that the inlet slider 15 and the outlet slider 13 tightly close despite the reduced thickness.

A piston receptacle 21 which receives the piston 20 is coupled with the intermediate plate 14 transversely to the piston longitudinal axis as shown in FIG. 2. Thereby the piston receptacle 21 and the piston 20 can be guided in the case of reduced thickness of the inlet slider 15 and the outlet slider 13 on the intermediate plate 14. An eccentric shaft 22 presses the piston receptacle 21 in direction of the piston longitudinal axis against a drive plate 24, in order to guarantee the coupling of the intermediate plate 14 with the piston 20 and the piston receptacle 21.

The cross-section of all material guiding passages 18, 18.1 is selected so that no transverse cross-section expansion takes place between the outer connections 23 and the nozzles 19. Moreover, the deviations of at most 90° in the passages 18, 18.1 are provided, so that a glass-fiber containing material can be utilized.

Figure 3:
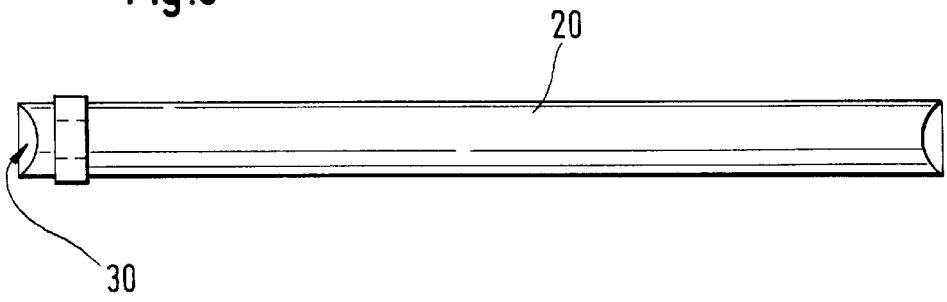
FIG. 3 is a side view of a piston of the inventive device for coating of workpieces of FIG. 1.

FIG. 3 shows a piston 20 of the device of FIGS. 1 and 2. Its end side 30 has a course which corresponds to the curved wall of the material guiding passage 18.1 of the intermediate plate 14. Thereby the piston 20 with its end side 30 during the discharge of the coating material and the material guiding passage 18.1 is connected flush with the wall of the material guiding passage 18. With the flush connection of the end side 30 with the wall of the material guiding passage 18, a generation of air enclosures in the coating material in the region of the piston 20 is excluded.

It will be understood that each of the elements described above, or two or more together, may also find a useful application in other types of constructions differing from the types described above.

While the invention has been illustrated and described as embodied in device for coating workpieces, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

What is claimed is:

1. A device for coating of workpieces, comprising an application unit provided with a distributing plate which has at least one nozzle and at least one valve unit, said at least one valve unit being formed as a plate valve with at least one inlet slider and at least one outlet slider, wherein said at least one valve unit is switched between a totally opened position and a totally closed position, wherein no sealing means are provided on the at least one valve unit, and wherein at least one piston is provided for pressing material to be applied to the workpieces out of at least one material guiding passage through said at least one nozzle when said at least one nozzle is open.

2. A device as defined in claim 1, and further comprising at least one intermediate plate located between said at least one inlet slider and said at least one outlet slider and provided with said at least one material guiding passage.

3. A device as defined in claim 2, wherein said at least one valve unit has at least one pressing plate provided with said at least one material-guiding unit and acted upon by a tensioning module.

4. A device as defined in claim 3, wherein said tensioning module is operative for applying a stroke-independent tensioning force.

5. A device as defined in claim 2, wherein said at least one intermediate plate has at least one opening which receives said at least one piston and opens laterally in said at least one material guiding passage.

6. A device as defined in claim 1, wherein said at least one piston is a motor driven piston.

7. A device as defined in claim 5, wherein said at least one piston is controlled so that it provides compensation of a material compression.

8. A device as defined in claim 5, and further comprising a receptacle provided for said at least one piston and coupled with said at least one intermediate plate in a direction perpendicular to a longitudinal axis of said at least one piston.

9. A device as defined in claim 8, and further comprising at least one eccentric shaft which presses said piston receptacle in a direction of the longitudinal axis of said at least one piston against a drive plate.

10. A device as defined in claim 5, wherein said at least one piston has an end wall which faces said at least one material guiding passage and corresponds to a curved course of a wall of said at least one material guiding passage.

11. A device as defined in claim 1, wherein said at least one material guiding passage is guided so that it provides a deviation of the material by at most 90°.

12. A device as defined in claim 1, wherein said at least one inlet slider and said at least one outlet slider have an outer surface provided with a projecting sliding region.

13. A device as defined in claim 3, wherein said at least one inlet slider, said at least one outlet slider, said at least one intermediate plate and said at least one pressing plate have sliding regions formed as exchangeable inserts.

14. A device as defined in claim 1, wherein said at least one material guiding passage reduces from a material inlet to a nozzle outlet.

* * * * *